US006474127B1

(12) United States Patent
Bonde

(10) Patent No.: US 6,474,127 B1
(45) Date of Patent: Nov. 5, 2002

(54) PRESSING METHOD, IN PARTICULAR FOR OBTAINING HYDRAULIC CYLINDERS AND HIGH-PRESSURE FILTERS

(75) Inventor: Gustave O. Bonde, Paris (FR)

(73) Assignee: Edmonton Consultadoria e Servicios Lda (PG)

( * ) Notice: Subject to any disclaimer, the term of this patent is extended or adjusted under 35 U.S.C. 154(b) by 0 days.

(21) Appl. No.: 09/870,437

(22) Filed: May 30, 2001

(51) Int. Cl.[7] ..... B21K 21/06
(52) U.S. Cl. ..... 72/356; 29/888.06
(58) Field of Search ..... 72/356, 358, 377; 29/888.06

(56) References Cited

U.S. PATENT DOCUMENTS 1,328,276 A * 1/1920 Fuchs ..... 29/888.06
3,561,242 A * 2/1971 Biginelli ..... 72/356
4,217,771 A * 8/1980 Braun ..... 72/358

* cited by examiner

*Primary Examiner*—Lowell A. Larson
(74) *Attorney, Agent, or Firm*—Ostrolenk, Faber, Gerb & Soffen, LLP

(57) ABSTRACT

The present invention relates to a pressing method for obtaining hydraulic cylinders and high-pressure filters, using a semifinished product consisting of a cylindrical part having a blind hole at one end and suitably treated by means of a first chemical surface treatment. The method comprises a first step in which positioning of the semifinished product in a die is performed, followed by a first pressing operation using a first punch acting over part of the depth of said blind hole, so as to define a first machined zone, followed by a second step consisting of first sizing of said first machined zone using a second reverse-profile punch, so as to define a second machined zone. A third step of performing a second chemical surface treatment, followed by a fourth step of pressing of said second machined zone using a third punch, so as to obtain a third machined zone with a desired thickness, and a fifth step of sizing of said third machined zone using a fourth punch, so as to define a flat contact zone.

20 Claims, 4 Drawing Sheets

PRESSING METHOD, IN PARTICULAR FOR OBTAINING HYDRAULIC CYLINDERS AND HIGH-PRESSURE FILTERS

BACKGROUND OF THE INVENTION

The present invention relates to a pressing method, in particular for obtaining hydraulic cylinders and high-pressure filters.

Nowadays, for the manufacture of these devices, methods of the known type such as, for example, hot-extrusion processes are used.

These hot-extrusion processes require the formation initially of a cylindrical metal part, such as, for example, a section of round bar or billet of suitable dimensions, cut to a length which is related to the volume of the part to be obtained.

The cylindrical part is heated to a temperature of about 1200° C. in a furnace usually of the gas type.

The punching step is then performed: the cylindrical part, still hot, is placed in a die inside a press and upsetting is performed using a punch until the typical bell shape is formed.

The part is then extracted still hot, ready for carrying out an external drawing operation: this procedure envisages that the metallic material, which is drawn by means of a tool called a drawplate, is profiled according to the shape of the latter.

Upon leaving the drawplate, the part has a deformed cross section, which is smaller than that upon entry, and a smaller thickness of the side walls, resulting from the use of a suitable spindle or punch located coaxially with said drawplate.

From this drawing operation, a rough semifinished product having an external and internal surface finish with scales, grooves and other imperfections is obtained: the concentricity tolerances, for example, may vary from 10% to 30% of the thickness of said rough semifinished product.

After this hot-drawing operation, a cold-drawing operation is envisaged, preceded by the following three steps: an external turning operation is performed so as to give the bell part obtained from extrusion a concentric shape, followed by a sandblasting operation and by a process involving phosphating of the semifinished product.

Normally cold-drawing is performed with several passes: the number of these passes depends on the thickness of the part to be obtained; after each pass, an annealing, phosphating and sandblasting operation must be performed.

The main disadvantage of this hot-extrusion and cold-drawing process consists in the fact that it requires very large and costly machinery and long tool-changing times: the minimum amount of parts required in order for this hydraulic cylinder and high-pressure filter manufacturing method to be economically viable must thus be not less than one hundred tons of parts.

Another disadvantage of this method of the known type consists in the fact that the product obtained therefrom requires further machining operations in order to fall within the range of required tolerance limits.

Internal and external turning are thus performed, eliminating the layer of material having metallurgical characteristics altered by heating: in machining operations of this type about 15–20% of the material is lost.

Another method of the known type for manufacturing hydraulic cylinders and high-pressure filters consists in chip-forming machining of a metallic cylindrical part, such as a rolled solid steel bar.

Partial boring is then performed in an axial direction, followed by turning of the external and internal surfaces.

The main disadvantage of this method of the known type consists in the fact of having long programmed machining times which result in an increase in the cost of each individual part.

Another drawback which the method described here has is that the abovementioned chip-forming machining operations result in considerable wear of the cutting tools.

This wear becomes even greater if materials with a carbon content of less than 0.20% are used; these materials, moreover, since they have a low chip-forming capacity, create problems with regard to the use of hard-metal bits, with a consequent further increase in the machining times and costs.

A further disadvantage consists in the huge quantity of swarf and waste material since normally, during these chip-forming machining operations, more than 80% of the material used is lost.

SUMMARY OF THE INVENTION

The main aim of the subject of the present invention is therefore that of solving the technical problems mentioned, eliminating the drawbacks according to said prior art, and therefore devising a method which allows devices such as hydraulic cylinders and high-pressure filters to be obtained, using simple machinery with small dimensions and power requirements and low costs.

In connection with the abovementioned aim, another important object is to provide a method which involves short tooling-up times so as to be able to handle batches with a small number of parts.

Yet another important object is to provide a method which produces an optimum finish with low surface and concentricity tolerances so as not to require further machining operations.

Another object consists in obtaining a product which has optimum mechanical characteristics, often avoiding the need for further heat treatment.

Another object consists in obtaining the product without the need for intermediate annealing and sandblasting operations, which are very costly and wasteful.

Yet another object consists in providing a method which does not require, during manufacture of the cylinder, any welding.

Last but not least, an object is to provide a method which is simple and economical, said method producing a small amount of swarf.

The aim and the abovementioned objects, as well as others which will appear more clearly below, are achieved by a pressing method, in particular for obtaining cylinders and filters, to be carried out on a semifinished product advantageously consisting of a cylindrical part axially having a blind hole at one end and suitably treated by means of a first chemical surface treatment of the known type, which is characterized in that it comprises the following steps:

- first pressing using a first punch acting over part of the depth of said blind hole, so as to define a first machined zone;
- first sizing of said first machined zone using a second reverse-profile punch, so as to define a second machined zone;

second chemical surface treatment of said semifinished product thus obtained;

second pressing of said second machined zone using a third punch, so as to define a third machined zone with a desired thickness for said semifinished product thus obtained;

second sizing of said third machined zone using a fourth punch, so as to define a fourth flat contact zone, so as to obtain said cylinder.

Further characteristic features and advantages of the invention will emerge more clearly from the detailed description of a particular embodiment, illustrated by way of a non-limiting example in the plates of accompanying drawings, in which:

DESCRIPTION OF A PREFERRED EMBODIMENT

Figure 1:
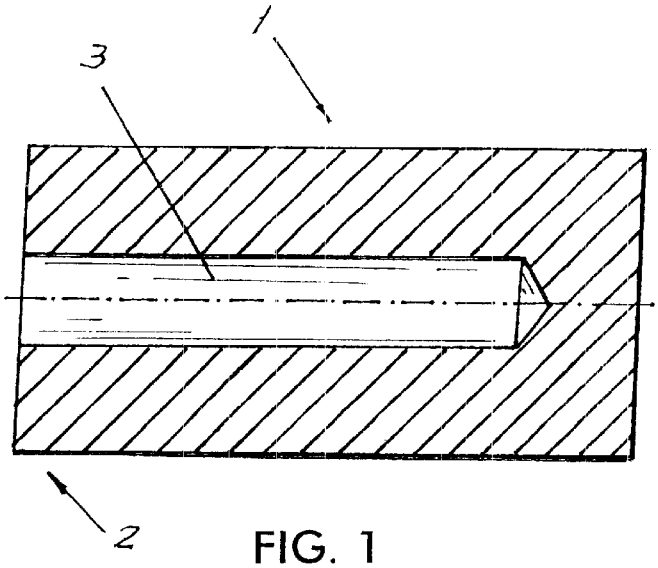
FIGS. 1 and 2 show a sectioned side view and top plan view, respectively, of a semifinished product consisting of an axially bored cylindrical part.

With reference to the abovementioned Figures, a semifinished product is advantageously obtained by means of suitable machining operations carried out on a cylindrical part advantageously obtained from a round bar of hot-rolled steel previously subjects to a peeling operation in order to remove the layer of material which altered metallurgical characteristics present on the external surface of said round bar.

At one end 2 of this cylindrical part, a partial boring operation is performed, in an axial direction, so as to obtain a blind hole 3.

During this step, about 10% of the material is lost in the form of swarf.

The semifinished product 1 is subjected beforehand also to a first chemical surface treatment of the known type, which envisages immersion thereof in sequence in the following solutions:

Alkaline degreasing solution based on sodium hydroxide and sodium metal silicates, in a percentage amount of between 2 and 15% in water, at a temperature of 70–95° C., for a period of time variable between 5 and 15 minutes;

Rinsing in hot water at a temperature of 60–85° C. for a period of time variable between 5 and 15 minutes;

Phosphating solution based on zinc diacid phosphate, nitric acid, zinc nitrate and phosphoric acid in a percentage amount, diluted in water, of between 5 and 20%, at a temperature of 60–85° C. for a variable between 5 and 15 minutes, so as to produce a compact and homogeneous zinc phosphate coating with a very fine crystalline structure so as to facilitate mechanical deformation of the cold material;

Rinsing in hot water at a temperature of 60–85° C. for a period of time variable between 5 and 15 minutes;

Alkaline-reaction, passivating, neutralising solution based on sodium borates, sodium carbonate and sodium sulphite in a percentage amount diluted in water up to a pH of between 7 and 9.5 for a period of time variable between 5 and 15 minutes;

Lubricating solution, for example soap, based on sodium stearates: the lubricant, reacting with the zinc phosphate coating, forms zinc soaps which provide the coating with a further improved anti-friction barrier associated with optimum lubrication. The percentage of dilution of the soap in water ranges from 3 to 12%, at a temperature of 60–80° C., for a period of time variable between 2 and 10 minutes.

Figure 2:
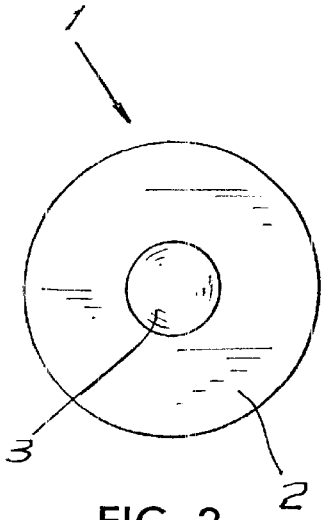
Figure 3:
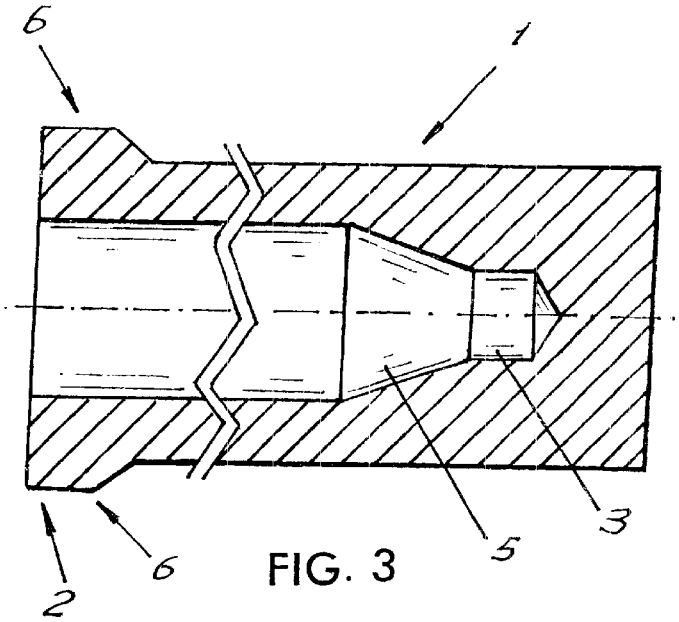
FIGS. 3 and 4 show a sectioned side view and top plan view, respectively, of said semifinished product after a first pressing operation.
Figure 4:
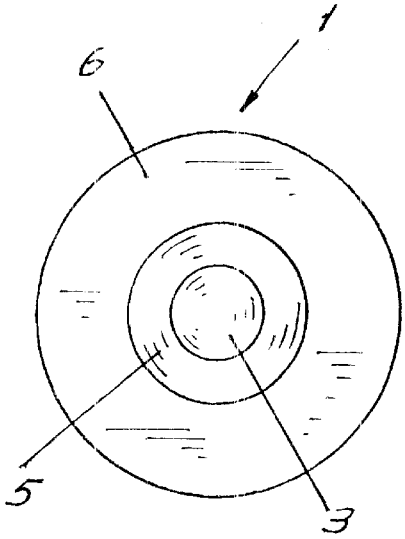
Figure 5:
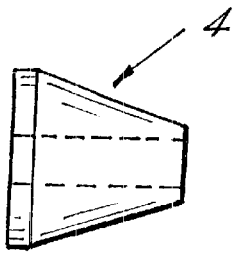
FIGS. 5 and 6 show a sectioned side view and top plan view, respectively, of the first punch for the first pressing operation.
Figure 6:
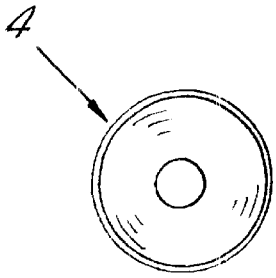
Figure 7:
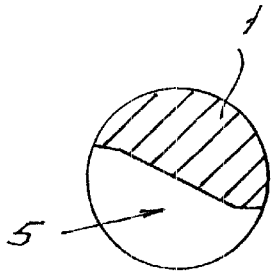
FIGS. 7 and 8 show a sectioned side view of a detail of FIG. 3 and FIG. 9, respectively.
Figure 8:
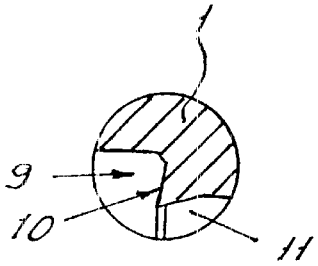
Figure 9:
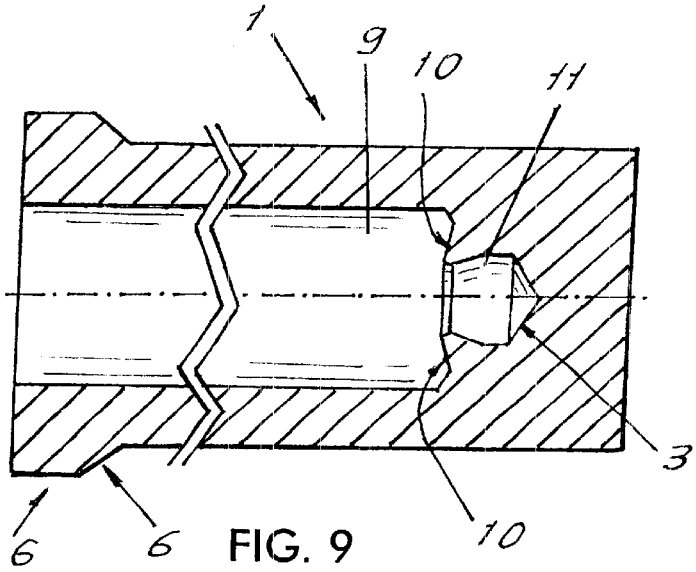
FIGS. 9 and 10 show a sectioned side view and top plan view, respectively, of said semifinished product after a first sizing operation.
Figure 10:
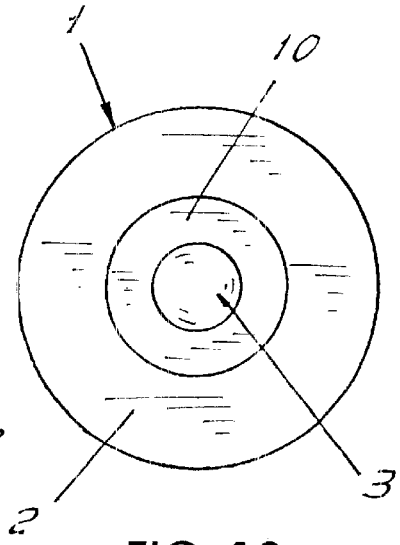

Starting therefore with said semifinished product 1, illustrated in FIGS. 1 and 2, the method comprises a first step in which, once said semifinished product 1 has been placed in a predetermined first die, a first pressing is performed using a first punch, indicated by the number 4.

This first punch 4 has an advantageously frustoconical shape, with a minimum diameter approximately equal to, or slightly smaller than, the diameter of said blind hole 3 and a flare angle of between 10° and 50°.

The first punch 4 acts along most of the depth of said blind hole 3, creating an enlargement thereof so as to define a first machined zone 5; at the same time, the flared shape of the first die, not shown in the figures, results in the formation of an external circular rim 6 at the end 2.

Figure 11:
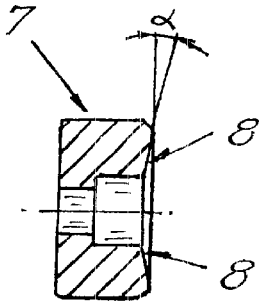
FIGS. 11 and 12 show a sectioned side view and top plan view, respectively, of the second punch for the first sizing operation.
Figure 12:
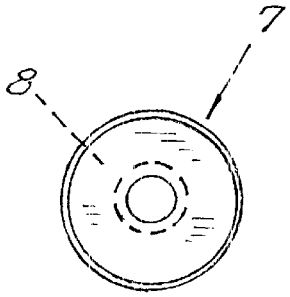
Figure 13:
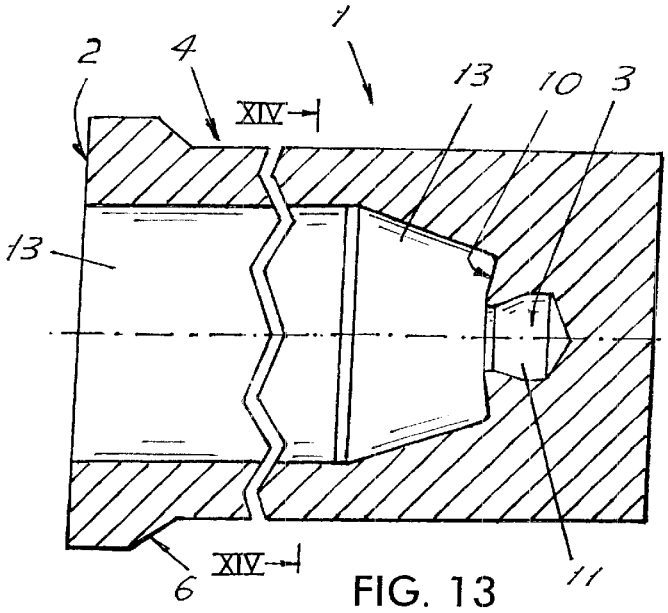
FIGS. 13 and 14 show a side view and top plan view, respectively, of two separate sections of said semifinished product after a second pressing operation.
Figure 14:
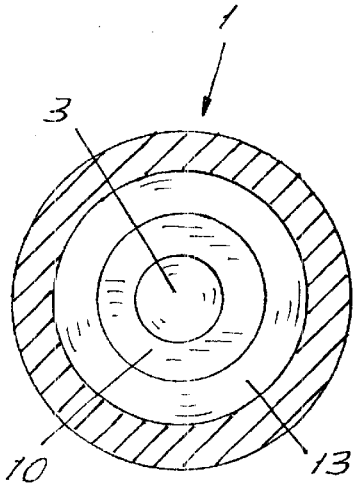

In a second step, a first sizing operation is carried out on said first machined zone 5, advantageously using a second punch 7 having a first concave front surface 8 so that, with reference to a longitudinal section such as that shown in FIG. 11, the inclination of the front surface with respect to the plane perpendicular to the axis of the second path 7 forms an angle $\alpha$ of between 5° and 10°.

This shape of said second punch 7, referred to as "reverse profile", is designed for form a second machined zone 9 suitably formed with a cylindrical surface.

At the terminal part of said second machined zone 9, opposite the end 2, there is a first annular surface 10 which forms the perimetral edge of a first contiguous cavity 11 formed by the non-machined terminal part of the blind hole 3.

Said second sizing step is then followed by a third step in which the semifinished product thus obtained is subjected to a second chemical surface treatment, advantageously similar to the first chemical surface treatment carried out prior to the first pressing.

This second chemical surface treatment is followed by a fourth step in which, after placing the semifinished product 1 in a second die bigger than the first die, a second pressing of said second machined zone 9 is performed using a third punch 12 having a shape preferably similar to that of the first punch 4, but with larger dimensions.

Figure 15:
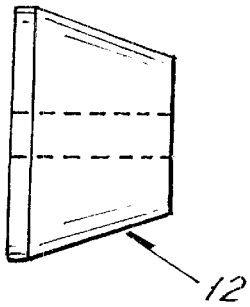
FIGS. 15 and 16 show a sectioned side view and top plan view, respectively, of the third punch for the second pressing operation.
Figure 16:
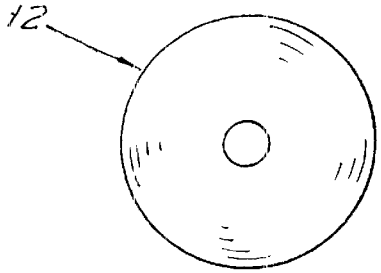
Figure 17:
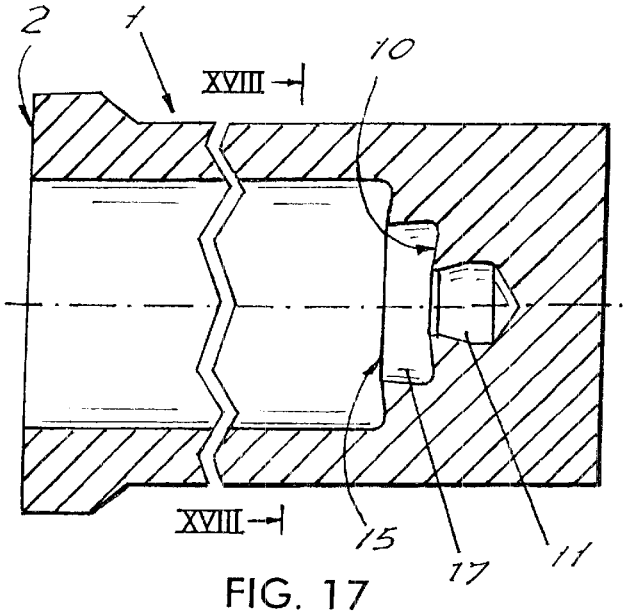
FIGS. 17 and 18 show a side view and top plan view, respectively, of two separate sections of said semifinished product after a second sizing operation.
Figure 18:
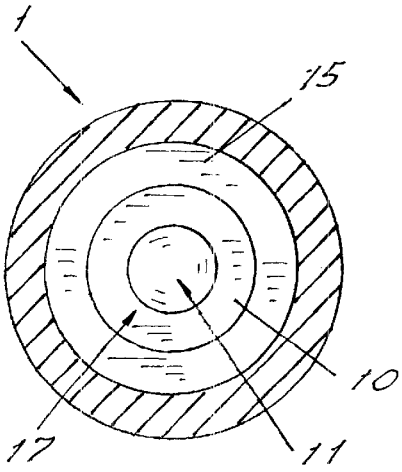
Figure 19:
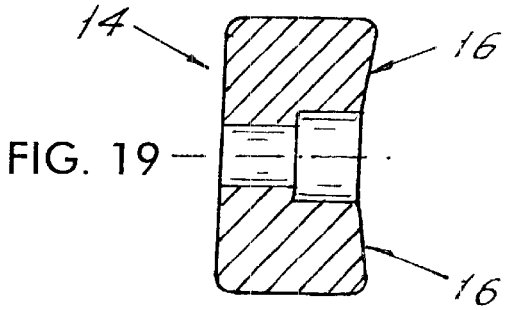
FIGS. 19 and 20 show a sectioned side view and top plan view, respectively, of a fourth punch for the second sizing operation.
Figure 20:
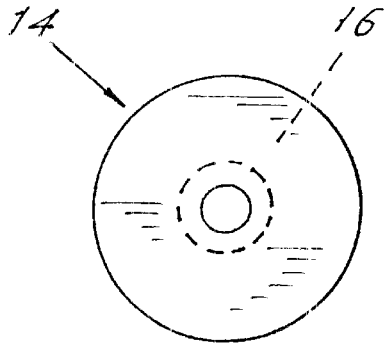

This third punch 12, illustrated in FIGS. 15 and 16, has in fact a frustoconical shape, with a minimum diameter approximately equal to, or slightly smaller than, the diameter of the second machined zone 9.

The second pressing performed by the third punch 12 is designed to define a third machined zone 13; at the same time, the thickness of the semifinished product 1 reaches the desired thickness.

A first and last step, necessary for obtaining the cylinder, comprises a second sizing operation carried out on said third machined zone 13 using a fourth punch 14 having a shape similar to that of the second punch 7, but with larger dimensions.

The fourth punch 14 also has a second concave front surface 16 so as to form a reverse profile designed to define a fourth flat contact zone 15 in said third machined zone 13.

This fourth flat contact zone 15 forms a separate annular surface which constitutes the perimetral edge of a second cavity 17 formed by the terminal part of the third machined zone 13, not modified by the second sizing operation.

The fourth flat contact zone 15 may be advantageously used, for example, as a stop surface for the head of the piston inside a hydraulic cylinder.

The second cavity 17 may advantageously serve as a seat for an optional sealing nut for the head of a piston.

Figure 21:
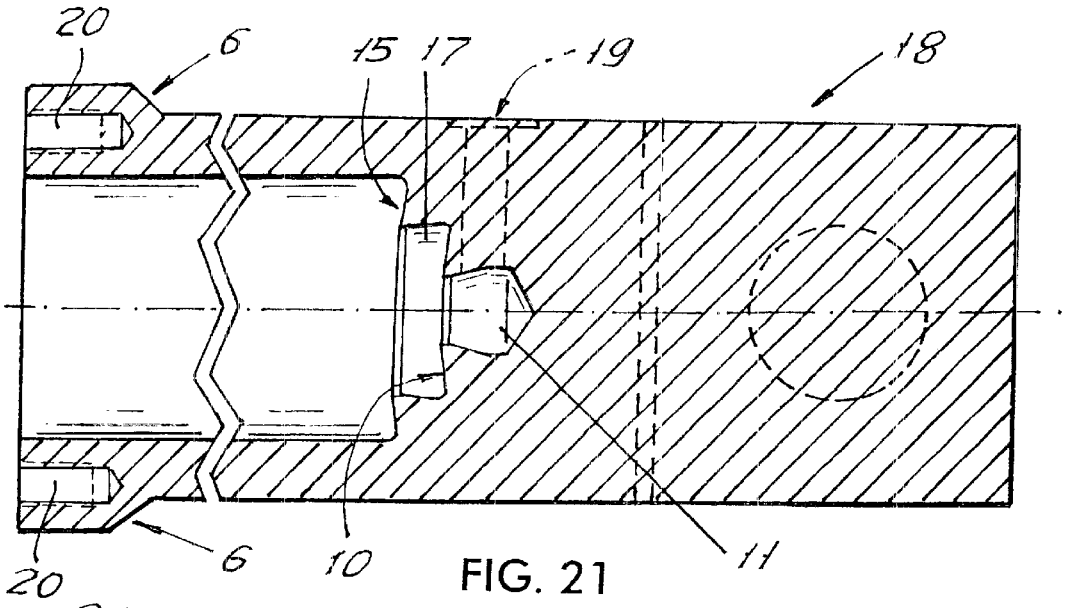
FIGS. 21 and 22 show the invention in side view along two separate sections.
Figure 22:
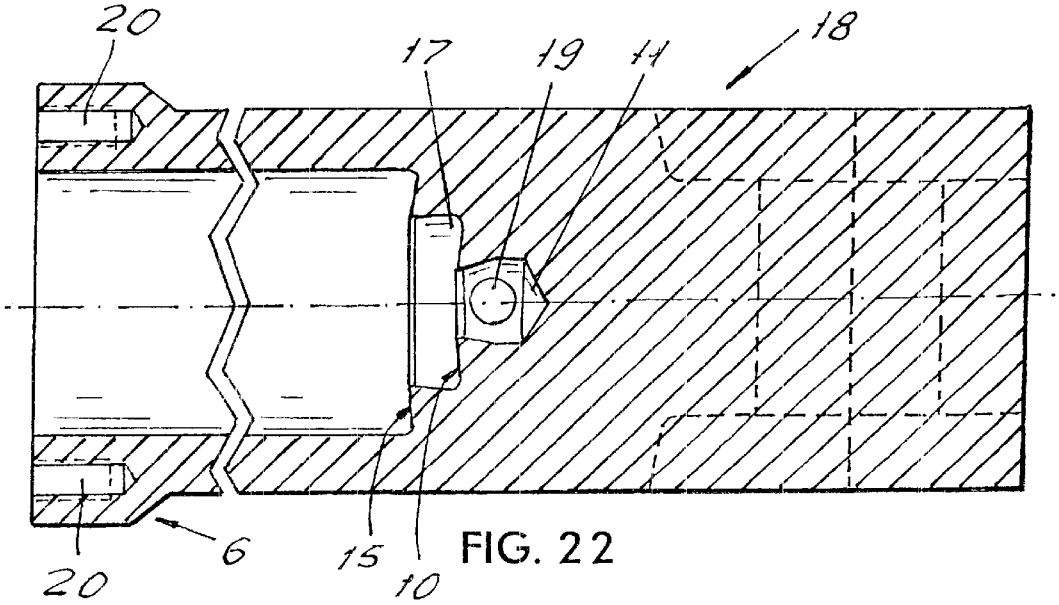

FIGS. 21 and 22 illustrate with the number 18 the cylinder obtained with this method; said cylinder has, formed in it, a radial bore 19 communicating with the first cavity 11 and designed to convey the liquid used in the cylinder.

Two pairs of threaded holes 20, designed for interconnection with a closing plate, not shown, are also advantageously formed on the external circular rim 6.

The first and the second die used respectively in the first and second steps and in the fourth and fifth steps may be advantageously made of special steel for hot-processing operations, for example of the type AISI/SAE H13.

The method described above is preferably applicable to products made of steel of the type ranging from AISI/SAE 1010 to AISI/SAE 4150, i.e. using special casehardening and tempering steels (C10-50CrMo4).

It has thus been possible to see how the invention has achieved the aim and the predefined objects, by devising a method which allows devices such as hydraulic cylinders and high-pressure filters to be obtained, using simple machinery with short tooling-up times, thus reducing the costs and allowing the handling of batches with a small number of parts.

The product obtained also has low surface and concentricity tolerances, such that it does not require further machining operations, and has optimum mechanical characteristics due to the work-hardening which the material undergoes during the die-forming operations.

Obviously the method may be subject to numerous modifications and variations, all of which fall within the scope of said inventive idea.

Obviously the materials used as well as the dimensions forming the individual components of the invention may be suitably adapted depending on the specific requirements.

What is claimed is:

1. A pressing method for obtaining cylinders and filters comprising:

providing a semi-finished product of cylindrical shape having a first end with a blind hole therein, wherein the semi-finished product has been subjected to a first chemical surface treatment;

inserting a first punch into and over part of the depth of the blind hole for defining a first machined zone in the hole, removing the first punch;

inserting a second, reversed profile punch in the hole for performing a first sizing of the first machined zone thereby defining a second machined zone; removing the second punch;

applying a second chemical surface treatment of the semi-finished product after the first sizing;

applying a pressing step in the second machined zone by inserting a third punch in the hole for defining a third machined zone with a selected thickness for the semi-finished product; removing the third punch;

performing a second sizing of the third-machined zone by inserting a fourth punch in the hole for defining a fourth flat contact zone in the third machined zone for producing the cylinder, and removing the fourth punch.

2. The method of claim 1, wherein the blind hole has a first cavity at the end thereof formed by the terminal end of the blind hole and the first cavity is not in and is beyond the machined zones;

the method further comprising forming a radial bore in the cylinder extending into the region of the first cavity of the blind hole.

3. The method of claim 1, wherein prior to the pressing step, placing the semi-finished product in a first die shaped so that during deformation of the semi-finished product, during the inserting of the first punch, the first die cooperates to define an external circular rim at the first end of the semi-finished product.

4. The method of claim 3, wherein prior to the second sizing step, the semi-finished product is placed in a second die with dimensions greater than the first die.

5. The method of claim 4, wherein the first and second dies are made of a steel adapted for hot, processing operations.

6. The method of claim 1, wherein the first punch has a first frustoconical shape, narrowing toward a leading end thereof and has a minimum diameter at the leading end which is less than the diameter of the blind hole.

7. The method of claim 6, wherein the first punch has a first frustoconical shape with a flare angle of between 10° and 50°.

8. The method of claim 6, wherein the third punch has a frustoconical shape, narrowing toward the leading end thereof and having a minimum diameter at the leading end which is less than the diameter of the blind hole.

9. The method of claim 1, wherein the second punch has a front surface which is a first concave surface.

10. The method of claim 9, wherein the first, front surface has a conical shape.

11. The method of claim 1, wherein when the second punch is viewed in longitudinal cross section, it has a front surface with an inclination with respect to a plane perpendicular to the axis of the second punch of between 5° and 10°.

12. The method of claim 1, wherein the second machined zone has a terminal part which includes a first annular surface opposite the end of the semi-finished product.

13. The method of claim 12, wherein the first annular surface forms a penmetral edge of the first cavity.

14. The method of claim 1, wherein the third punch has a frustoconical shape, narrowing toward the leading end thereof and having a minimum diameter at the leading end which is less than the diameter of the blind hole.

15. The method of claim 14, wherein the third punch has dimensions greater than the first punch and a flare angle of between 10° and 15°.

16. The method of claim 1, wherein the fourth punch has greater dimensions than the second punch and the fourth punch has a second front surface which is a second concave surface.

17. The method of claim 16, wherein the second front surface of the second punch is conical in shape.

18. The method of claim 17, wherein the fourth punch viewed in longitudinal cross section has a front surface with an inclination with respect to a plane perpendicular to the axis of the second punch of between 5° and 10°.

19. The method of claim 1, wherein the fourth flat contact zone is a second annular surface which defines the perimetral edge of a second cavity that is formed by the terminal part of the third machined zone which has not been modified by the second sizing step.

20. The method of claim 1, further comprising forming a plurality of threaded holes for interconnection with a closing plate on the external circular part at the end in which the blind hole is defined.

* * * * *